US008894467B2

(12) United States Patent
Santure

(10) Patent No.: US 8,894,467 B2
(45) Date of Patent: Nov. 25, 2014

(54) SURFACE MEDIA BLASTING SYSTEM AND METHOD

(76) Inventor: Robert J. Santure, Saline, MI (US)

( * ) Notice: Subject to any disclaimer, the term of this patent is extended or adjusted under 35 U.S.C. 154(b) by 199 days.

(21) Appl. No.: 13/507,374

(22) Filed: Jun. 22, 2012

(65) Prior Publication Data

US 2013/0196574 A1 Aug. 1, 2013

Related U.S. Application Data

(60) Provisional application No. 61/571,228, filed on Jun. 23, 2011.

(51) Int. Cl.

| | |
|---|---|
| ***B24B 1/00*** | (2006.01) |
| ***B08B 9/093*** | (2006.01) |
| ***B24C 3/04*** | (2006.01) |
| ***B24C 3/06*** | (2006.01) |
| ***B24C 9/00*** | (2006.01) |

(52) U.S. Cl.

CPC . *B08B 9/093* (2013.01); *B24C 3/04* (2013.01); *B24C 3/06* (2013.01); *B24C 9/00* (2013.01)

USPC ..... 451/38; 451/2; 451/5; 451/6; 451/75; 451/92

(58) Field of Classification Search

CPC ..... B24C 3/06; B24C 3/065; B24C 3/062; B24C 3/32; B24C 3/067

USPC ..... 451/29–43, 2, 5, 6, 75, 92, 439; 134/172, 174, 179, 180, 181, 198

See application file for complete search history.

(56) References Cited

U.S. PATENT DOCUMENTS

| | | | | | |
|---|---|---|---|---|---|
| 1,345,834 | A | * | 7/1920 | Lee | 118/207 |
| 3,396,492 | A | * | 8/1968 | Schenck | 451/92 |
| 3,548,541 | A | * | 12/1970 | Miller | 451/75 |
| 3,566,543 | A | * | 3/1971 | Fogle | 451/2 |
| 3,863,393 | A | * | 2/1975 | Goff | 451/92 |
| 4,055,139 | A | * | 10/1977 | Scheiding | 114/382 |
| 4,139,970 | A | * | 2/1979 | Hockett | 451/90 |
| 4,199,905 | A | * | 4/1980 | Neidigh et al. | 451/92 |

(Continued)

FOREIGN PATENT DOCUMENTS

WO WO 9748527 A1 * 12/1997 ..... B24C 3/06

*Primary Examiner* — George Nguyen

(74) *Attorney, Agent, or Firm* — Gerald R. Black, Esq.

(57) ABSTRACT

The system delivers media blasting material to an interior surface of a large storage tank comprises a substantially upright support structure secured to the surface to be blasted. The upright support structure is preferably vertical. A frame extends across the upright support structure. An extendable arm is affixed to the frame at a section. The section is securely and pivotably attached to the section in such a way to enable the arm to rotate freely inside the large storage tank, so that the blaster secured at the end of the extendable arm can blast the entire interior surface of the large storage tank while the upright support structure remains in place. A robot blaster is positioned at the end of the extendable arm and performs the media blasting. A work station is located nearby the site of the large storage tank and controls the position of the extendable arm relative to the interior surface being blasted via a processor and the operation of the blasting delivery system. The surfaces to be blasted may also include the exterior surface of all types of large storage tanks and structures, ship hulls, exterior and interior building wall surfaces.

16 Claims, 5 Drawing Sheets

(56) References Cited

U.S. PATENT DOCUMENTS

| | | | | | |
|---|---|---|---|---|---|
| 4,286,417 | A | * | 9/1981 | Shelton | 451/2 |
| 4,445,451 | A | * | 5/1984 | van den Broek | 114/222 |
| 4,545,156 | A | * | 10/1985 | Hockett | 451/2 |
| 4,825,598 | A | * | 5/1989 | Schlick | 451/87 |
| 5,138,800 | A | * | 8/1992 | Janusz | 451/5 |
| 5,240,503 | A | * | 8/1993 | Levy et al. | 118/323 |
| 5,291,695 | A | * | 3/1994 | Healy et al. | 451/89 |
| 5,309,683 | A | * | 5/1994 | Hockett | 451/87 |
| 5,339,573 | A | * | 8/1994 | Uchida et al. | 451/92 |
| 5,367,841 | A | * | 11/1994 | Smith et al. | 451/89 |
| 5,398,632 | A | * | 3/1995 | Goldbach et al. | 114/222 |
| 5,540,172 | A | * | 7/1996 | Goldbach et al. | 114/222 |
| 5,730,646 | A | * | 3/1998 | Watkin | 451/92 |
| 5,765,578 | A | * | 6/1998 | Brandt et al. | 134/7 |
| 5,807,168 | A | * | 9/1998 | Goldbach | 451/75 |
| 5,901,720 | A | * | 5/1999 | Lange | 134/172 |
| 5,964,645 | A | * | 10/1999 | Jemt | 451/41 |
| 6,070,371 | A | * | 6/2000 | Myrick | 52/63 |
| 6,102,157 | A | * | 8/2000 | Goldbach et al. | 182/128 |
| 6,328,813 | B1 | * | 12/2001 | Dornier | 134/18 |
| 6,402,587 | B1 | * | 6/2002 | Nopwaskey et al. | 451/2 |
| 6,675,548 | B2 | * | 1/2004 | Bristol et al. | 52/745.01 |
| 6,749,490 | B1 | * | 6/2004 | Hafenrichter | 451/75 |
| 7,311,162 | B2 | * | 12/2007 | Jeswine et al. | 180/164 |
| 7,316,604 | B1 | * | 1/2008 | Burks | 451/354 |
| 7,455,570 | B2 | * | 11/2008 | Yanaka et al. | 451/38 |
| 8,464,804 | B2 | * | 6/2013 | Beaudry et al. | 173/1 |
| 2008/0235928 | A1 | * | 10/2008 | Mars | 29/81.06 |
| 2008/0287039 | A1 | * | 11/2008 | Connelly | 451/38 |
| 2010/0178849 | A1 | * | 7/2010 | Gobbi | 451/41 |
| 2013/0043094 | A1 | * | 2/2013 | Lee | 182/113 |
| 2013/0196574 | A1 | * | 8/2013 | Santure | 451/38 |

* cited by examiner

SURFACE MEDIA BLASTER

SURFACE MEDIA BLASTER

SURFACE MEDIA BLASTER

SURFACE MEDIA BLASTER
SUPPORT STRUCTURE

SURFACE MEDIA BLASTER

SURFACE MEDIA BLASTING SYSTEM AND METHOD

This application is related to and claims priority to U.S. Provisional Application No. 61/571,228, entitled "Interior Surface Media Blaster", filed on Jun. 23, 2011.

FIELD OF USE

The present invention relates to a device allowing a more efficient method of cleaning of both interior and exterior surfaces that require periodic cleaning, painting, and maintenance, such as large storage tanks, and particularly, water towers.

BACKGROUND OF THE INVENTION

Prior approaches utilize a team using blasting pots, which are kept outside the water tower, with a line running inside the tower while the operator is suspended via harness. This method is very time consuming as the operator can only media blast small sections at a time and must continually readjust the harness when moving to a new section. Not only is this very time consuming and dangerous, but injuries are extremely common using this method. Down time for the water tower is often eight weeks, which means the municipality in question must either deal with lower water pressure, or a special pump truck must be brought in to keep water pressure up while work is being performed, which can be very expensive for small municipalities with only one water tower, and also for larger municipalities who may have several towers undergoing work, necessitating the rental of multiple pump trucks to keep pressure at tolerable levels for residents.

U.S. Pat. Nos. 7,311,162 and 6,742,617 (Jeswine, et al.) disclose apparatuses and methods for traversing compound curved and other surfaces. A traction unit capable of traversing and turning on surfaces that include compound curves like the surface of a sphere or are inverted like a ceiling. The traction unit includes a plurality of trucks operable to propel the unit across a surface and a plurality of adherence members operable to releasably secure the unit to the surface. In operation, the adherence members cyclically attach to and release from the surface as the trucks propel the unit across the surface. Within each cycle, after the unit has traveled a predetermined distance relative to an attached member, the member releases the surface and reattaches to the surface at a different point.

U.S. Pat. No. 7,194,334 (Laski) discloses a method of washing a contaminant from a surface via a robotic arm. A robotic wash cell including a six-axis robotic arm and end effector equipped with nozzles that spray unheated, solvent free, pure water at high-pressure to clean or debur objects by maintaining the nozzles in close proximity and substantially normal to each surface being cleaned or edge being deburred. The robotic cell wash is particularly useful for cleaning contaminants such as oil and grease from items having more complex shapes. The six-axis robotic arm positions the nozzles and their sprays substantially normal to each surface being cleaned or deburred. The nozzles produce a multi-zone spray pattern with a continuous effective cleaning zone. A water recycling and pressurizing system collects the used water, separates out the oil and grease contaminants to a level of about 5 ppm, and pressurizes the pure water to about 3,000 psi for washing operations or about 6,000 psi for deburring operations.

U.S. Pat. No. 5,441,443 (Roberts) discloses an apparatus for blast cleaning surfaces disposed at angles within 45° of vertical. A blast cleaning machine which gravity feeds abrasive material when blasting at positions from angularly upward to angularly downward. The machine includes a housing, a blast assembly, a motor for rotatably driving the blast assembly and a hopper. The housing has a blast corridor, a return corridor and a blast opening communicating with the blast corridor and the return corridor. The blast assembly receives abrasive material from the hopper and propels the abrasive material through the blast corridor and blast opening against the surface to be blast cleaned. The hopper has straight walls which are substantially parallel with the blast opening for gravity feeding abrasive material straight into the blast assembly. The walls of the hopper provide effective gravity feeding of abrasive material to the blast assembly when the machine is blasting anywhere between a 45° angle upward and a 45° downward.

U.S. Pat. No. 5,545,074 (Jacobs) discloses A closed-environment wet-abrasive blasting system includes a vacuum device for recovering a waste stream of water, abrasive particulate and surface debris. The waste stream is filtered resulting in cleaned water recycling through the system. During operation, water is pumped from a water holding tank to a blast head. Also, abrasive particulate is forced from canister to the blast head. The abrasive material and water form a blast stream which impacts on a surface to treat the surface. The blast head is held to the surface during use by the suction force and defines a work volume over the surface under treatment. In effect, the blast head defines a closed environment in which abrasive particulate water and surface debris do not escape into the surrounding environment, but instead is captured. The vacuum force pulls the surface debris, abrasive particulate and water (i.e., waste stream) from the blast head along a vacuum hose into a recovery tank. There the waste stream accumulates while air passes on to the vacuum. As the waste accumulates, the level rises to a filter. The filter passes air and water, and substantially filters out the abrasive material and surface debris leaving the abrasive particulate and surface debris in the recovery tank. The water and air pass into the water holding tank. The air is pulled into the water recovery tank through a screen that breaks air bubbles up into smaller air bubbles.

Therefore, a need exists for enabling an operator to safely and more efficiently perform the cleaning and painting of the interior and exterior of large storage tanks and structures, particularly water towers, more efficiently and reduce system downtime during said cleaning and painting.

The object of the present invention is to decrease water tower downtime, thus reducing the cost to the municipality in having to rent special equipment to maintain water pressure while work is being performed, and increase operator efficiency by not requiring said operator to constantly readjust the work harness. These repeated adjustments can cause injury if the operator is fatigued and the harness is not set up properly, and eliminate the need for operators to be inside the water tower, or standing on a scaffold attached to the outside for long periods of time, reducing fatigue and risk of injury to the operator.

Another object of the present invention will provide for cost, and time savings to the operator as less time is required to perform the same amount of work, as fewer workers are needed onsite and faster turn around time.

SUMMARY OF THE INVENTION

The surface media blasting system and method of the present invention addresses these objectives and these needs.

As used herein, "media blasting" is the process of blasting an item with small particles of various abrasive substances at an extremely high velocity in order to make changes to the surface. Sand blasting and soda blasting are two of the most common types of blasting, employing sand and baking soda, respectively. However, other common blasting media include, but are not limited to, metal, copper, grit, garnet, salt, sand, glass beads, metal, minerals, crushed nuts or fruit, corn, wheat and even dry ice. Media blasting is used to alter a surface, by forcibly propelling a stream of material against the surface under high pressure to smooth a rough surface, roughen a smooth surface, shape a surface, or remove surface contaminants.

The surfaces to be blasted include, but are not limited to, both the exterior and interior surfaces of all types of large storage tanks and structures, particularly, water storage tanks, oil storage tanks, chemical storage tanks, ship hulls, and interior and exterior building wall surfaces.

The system for delivering media blasting material to an interior surface of a large storage tank of the present invention comprises a substantially upright support structure secured to the surface to be blasted. The upright support structure is preferably vertical. A frame extends across the upright support structure. An extendable arm is affixed to the frame at a section. The section is secured and pivotably attached to the section in such a way as to enable the arm to rotate freely inside the large storage tank, so that the blaster secured at the end of the extendable arm can blast the entire interior surface of the large storage tank while the upright support structure remains in place.

In a first preferred embodiment of surface media blaster of the present invention, a person is positioned at the end of the extendable arm and performs the media blasting. In a second preferred embodiment of surface media blaster of the present invention, a robot blaster is positioned at the end of the extendable arm and performs the media blasting.

A work station is located nearby the site of the large storage tank and controls the position of the extendable arm relative to the interior surface being blasted via a processor and the operation of the blasting delivery system.

For a complete understanding of the interior/exterior surface media blaster of the present invention, reference is made to the accompanying drawings and description in which the presently preferred embodiments of the invention are shown by way of example. As the invention may be embodied in many forms without departing from spirit of essential characteristics thereof, it is expressly understood that the drawings are for purposes of illustration and description only, and are not intended as a definition of the limits of the invention.

DETAILED DESCRIPTION OF THE PREFERRED EMBODIMENTS

Figure 1A:
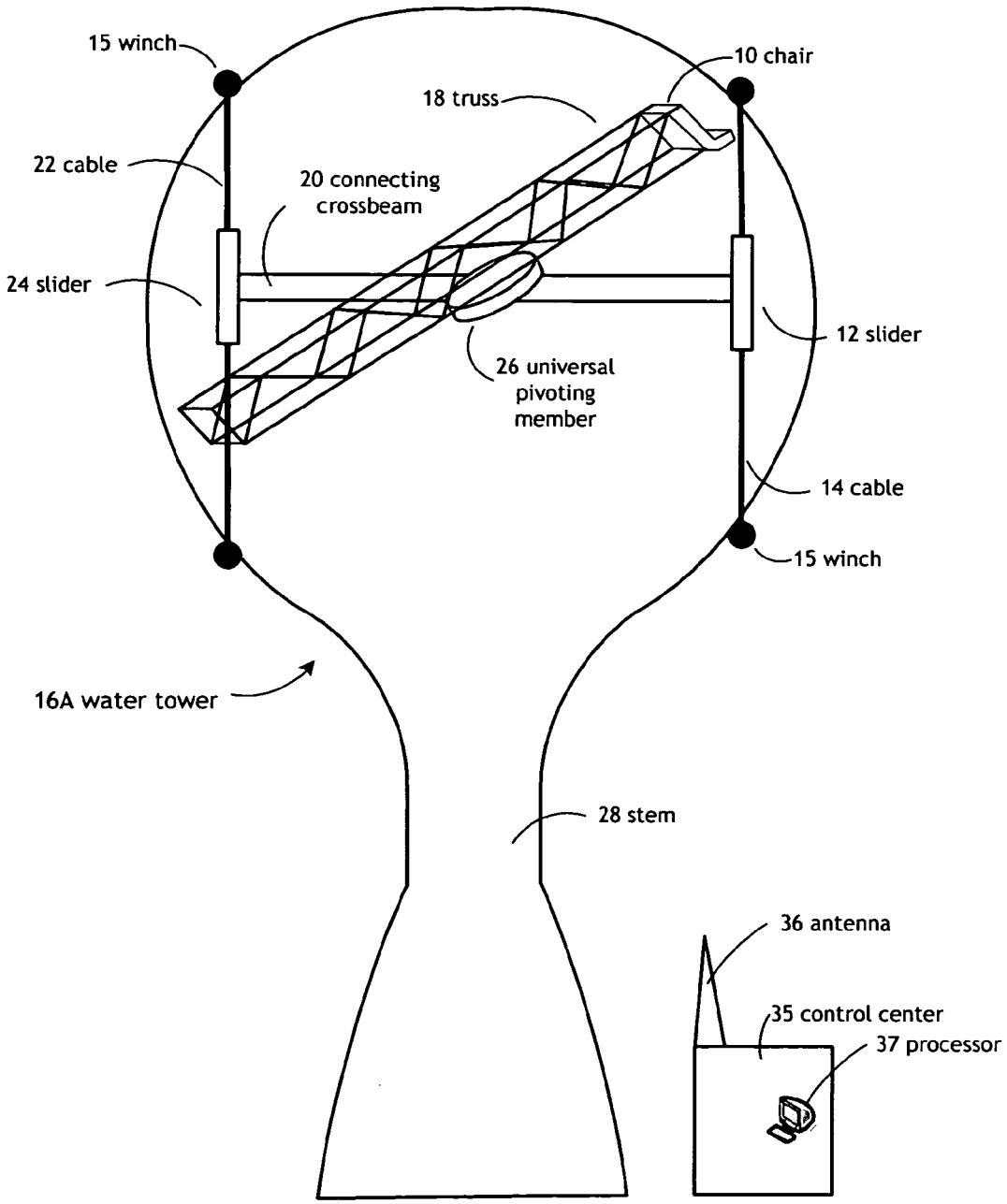
FIG. 1A discloses a first preferred embodiment of the surface media blaster system of the present invention disposed inside a different construction-type of water tower, a pair of cables being vertically suspended within the water tower, a connecting crossbeam being vertically attached to said pair of cables, a truss being pivotally attached to said crossbeam, and a chair being disposed at the end of the truss enabling the interior of the water tower to be blasted and subsequently painted.

Now referring to the drawings, FIG. 1A a first preferred embodiment of the surface media blaster system of the present invention disposed inside a water tower. The media blasting apparatus is disposed inside of a ball-shaped water tower [16A] with each pair of cables [14, 22] attached at either end of said unit to the water tower [16A] by a pair of winches [15]. Riding upon pair of the cables [14, 22] are the sliders [12, 24], respectively, which allow the vertical movement of the unit as each section of the interior surface of the water tower [16A] is being blasted. Attached to the sliders [12, 24] is the connecting cross beam [20] with the universal pivoting member [26] located proximate to the center of the connecting crossbeam [20]. The blasting is performed manually by a person positioned in a chair, seat, or basket [10] positioned at the end of an extendable arm [18]. A universal pivoting member [26] attaching the extendable arm [18] to the connecting crossbeam [20] enables a full 360° of rotation of the person positioned in the chair, seat, or basket [10] relative to the interior surface of the water tower [16A]. A control center [35] is situated near the water tower [16A], and enables the position and orientation of the manual operator to be programmed and controlled remotely.

Figure 1B:
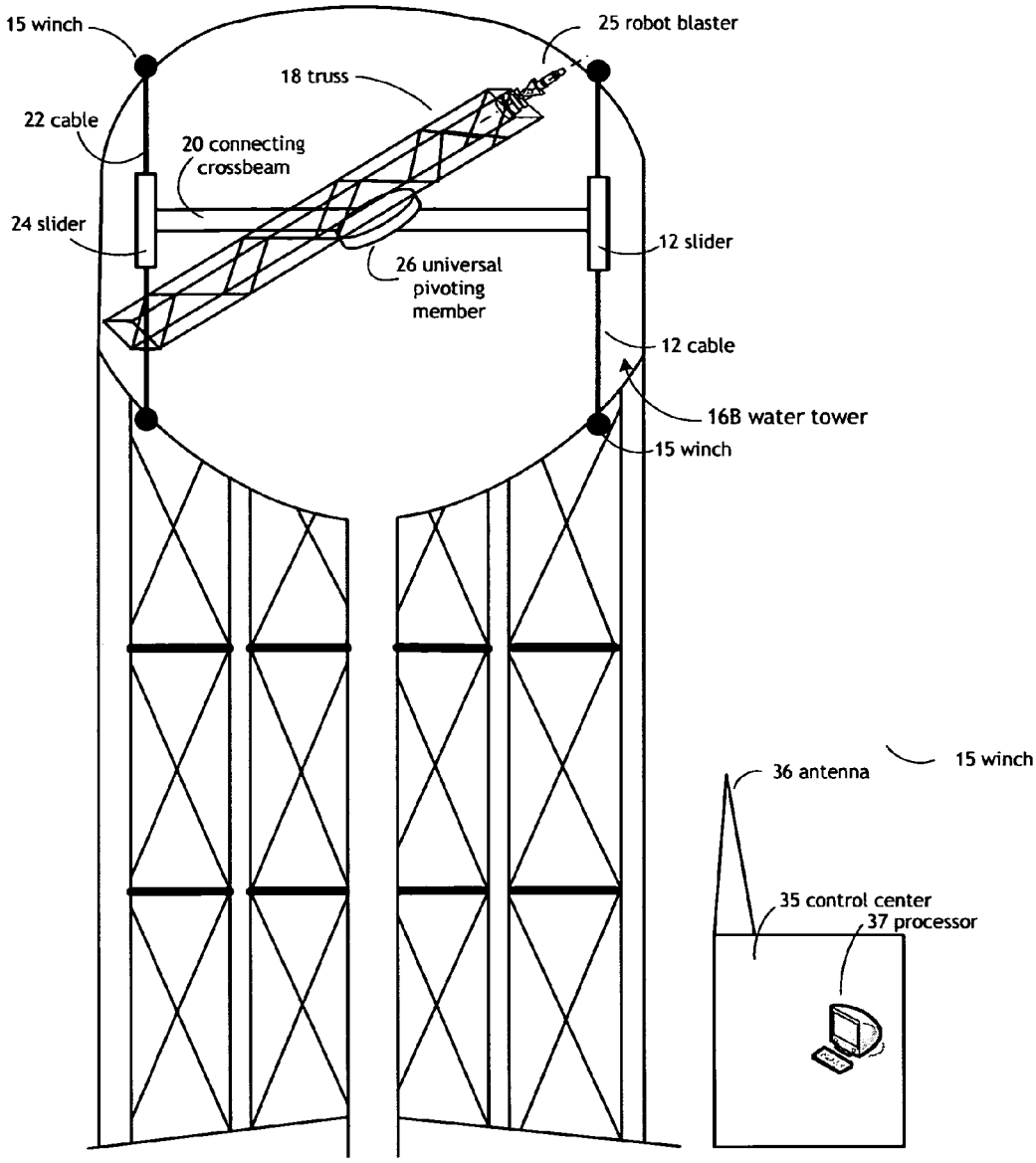
FIG. 1B discloses a variation of the first preferred embodiment of the surface media blaster system of the present invention disposed inside a water tower, a pair of cables being vertically suspended within the water tower, a connecting crossbeam being vertically attached to said pair of cables, an extendable arm being pivotally attached to said crossbeam, and a robot blaster being disposed at the end of the extendable arm enabling the interior of the water tower to be blasted and subsequently painted.

FIG. 1B a variation of the first preferred embodiment of the surface media blaster system of the present invention disposed inside a water tower. The media blasting apparatus is disposed inside of a ball-shaped water tower [16B] with the pair of cables [14, 22] attached at either end of said unit.

Riding upon pair of the cables [14, 22] are the sliders [12, 24], respectively, which allow the vertical movement of the unit as each section of the interior surface of the water tower [16B] is being blasted. Attached to the sliders [12, 24] is the connecting cross beam [20] with the universal pivoting member [26] located proximate to the center of the connecting crossbeam [20]. The blasting is performed by a robot blaster [25] disposed at the end of an extendable arm [18]. A universal pivoting member [26] attaching the extendable arm [18] to the connecting crossbeam [20] enables a full 360° of rotation of the robot blaster [25] relative to the interior surface of the water tower [16B]. A control center [35] is situated near the water tower [16B], and enables the position and orientation of the manual operator to be programmed and controlled remotely. Also, a series of cameras are attached to the end of the extendable arm, enabling remote operation of said arm, the cameras provide night vision capability. The cameras that provide night vision capability, lighting and sight distance meters are used in the area of the surface blasting to illuminate the area to be blasted, and are essential for the remote control station. In an alternative embodiment, U.S. Patent Application No. 20120062744 (Schofield et al) depicts a rear vision system for a vehicle with an LED system and camera components that is analogous to a configuration that is used for the surface media blasting of the present invention.

One robot blaster [25], of choice, is commercially available from Fanuc Robotics of Rochester Hills, Mich. and is Model #M-900iA. Additional robot blasters [25], of choice, are commercially available from Fanuc Robotics of Rochester Hills, Mich. and either are the ARC Mate® Model#120iC or the ARC Mate® Model#120iC/10L.

Figure 2:
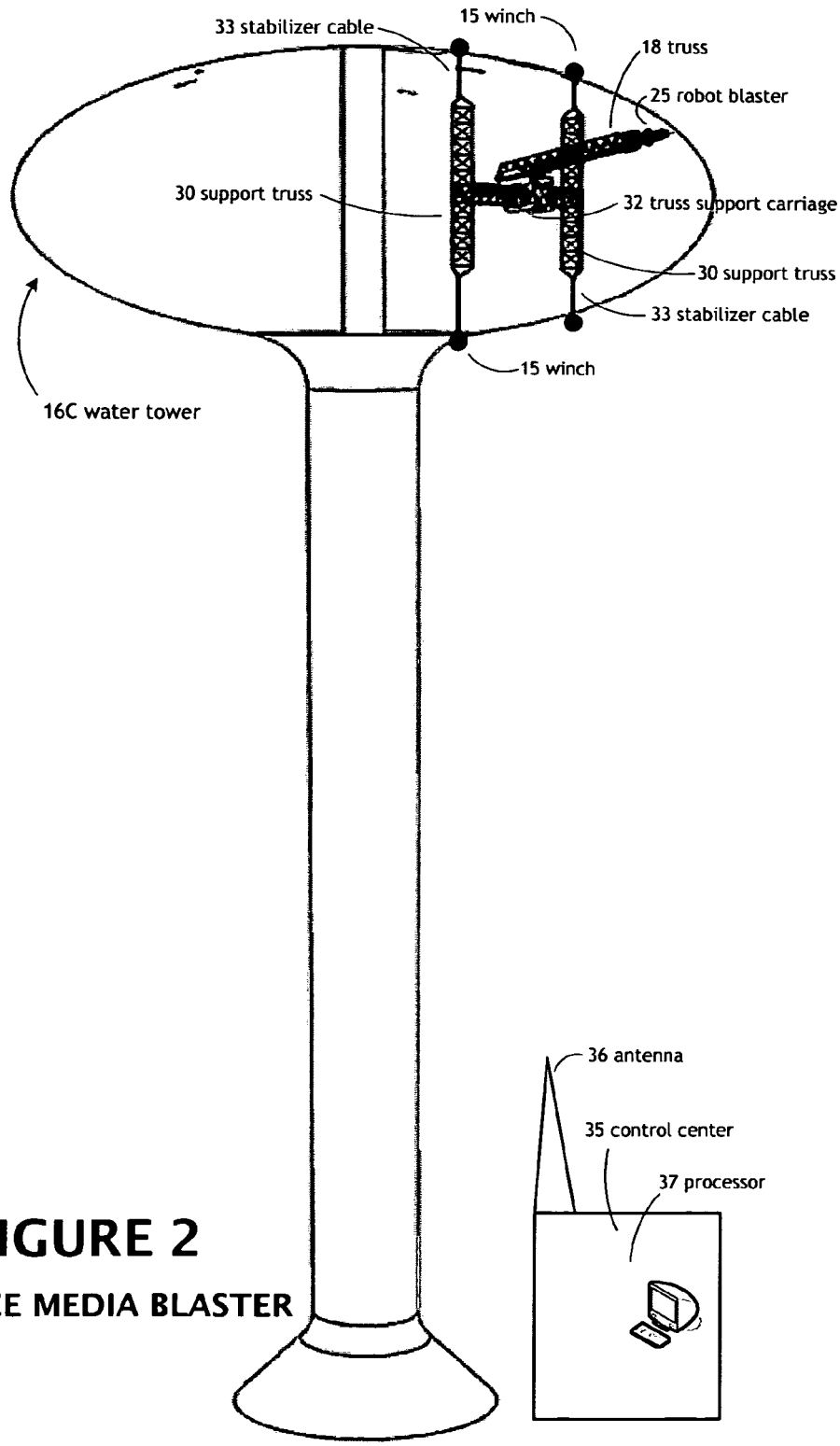
FIG. 2 discloses another preferred embodiment of the surface media blaster system of the present invention disposed inside a water tower, a pair of upright support trusses being vertically suspended within the water tower, a connecting crossbeam being vertically attached to said pair of upright support trusses, and a truss being pivotally attached to said connecting crossbeam, and a robot blaster disposed at the end of the extendable arm enabling the interior of the water tower to be blasted.
Figure 3:
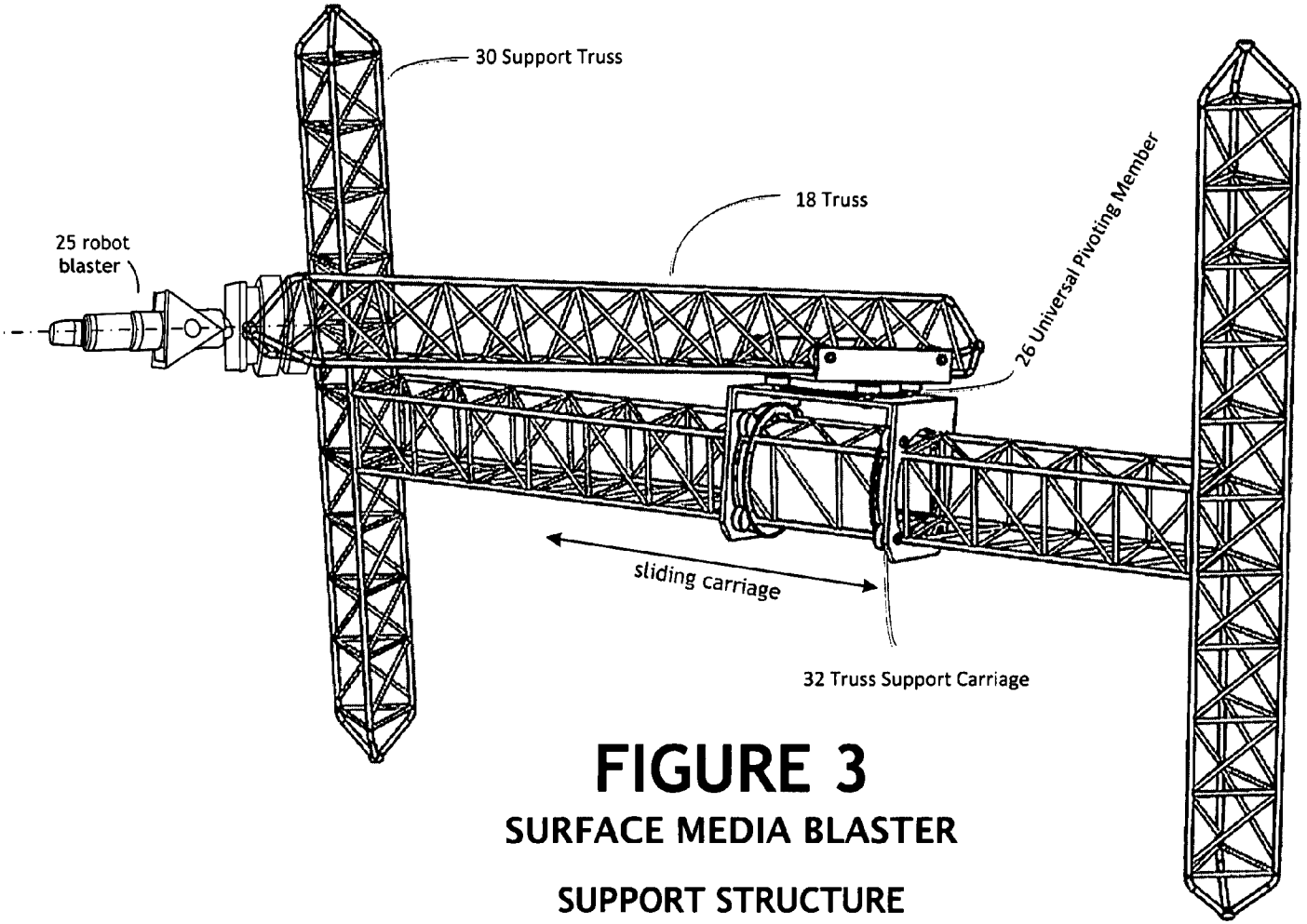
FIG. 3 discloses an exploded view of the preferred embodiment of the support structure for the surface media blaster of FIG. 2, with the pair of upright support trusses being vertically suspended within the water tower, a connecting crossbeam being vertically attached to said pair of upright support trusses, and a truss being pivotally attached to said connecting crossbeam, and a robot blaster disposed at the end of the extendable arm enabling the interior of the water tower to be blasted.

FIGS. 2 and 3 disclose another preferred embodiment of the surface media blaster system of the present invention disposed inside a water tower. As best seen in FIG. 3, a pair of upright substantially support trusses [30] are vertically suspended within the water tower interior of the water tower [16C] by a pair of stabilizer cables [33] which are each secured to the water tower [16C] by a pair of winches [15], and a truss support carriage [32] slides back and forth along a connecting truss (not labeled) extending between the pair of upright substantially support trusses [30]. The blasting is performed by a robot blaster [25] disposed at the end of an extendable truss arm [18]. A universal pivoting member [26] attaching the extendable arm [18] to the connecting crossbeam [20] enables a full 360° of rotation of the robot blaster [25] relative to the interior surface of the water tower [16C]. A control center [35] is situated near the water tower [16C], and enables the position and orientation of the manual operator to be programmed and controlled remotely. The winches [15], stabilizer cables 33, and trusses will need to be repositioned several times to completely blast the interior surface of the water tower [16C}.

The solid trusses enable the unit, via worm gear drives, chain drive, or servo motors, to move back and forth along the center support truss with great precision while also allowing the arm to move 360° and extend and retract as before. The extending and retracting of the arm can also use, depending on the precision required, servo motors, chain, or worm gear drive. Further, the center truss may be removed and attached to a lift which also has a special carriage attached to the end to allow for 360° of rotation, for the use in external applications.

Figure 4:
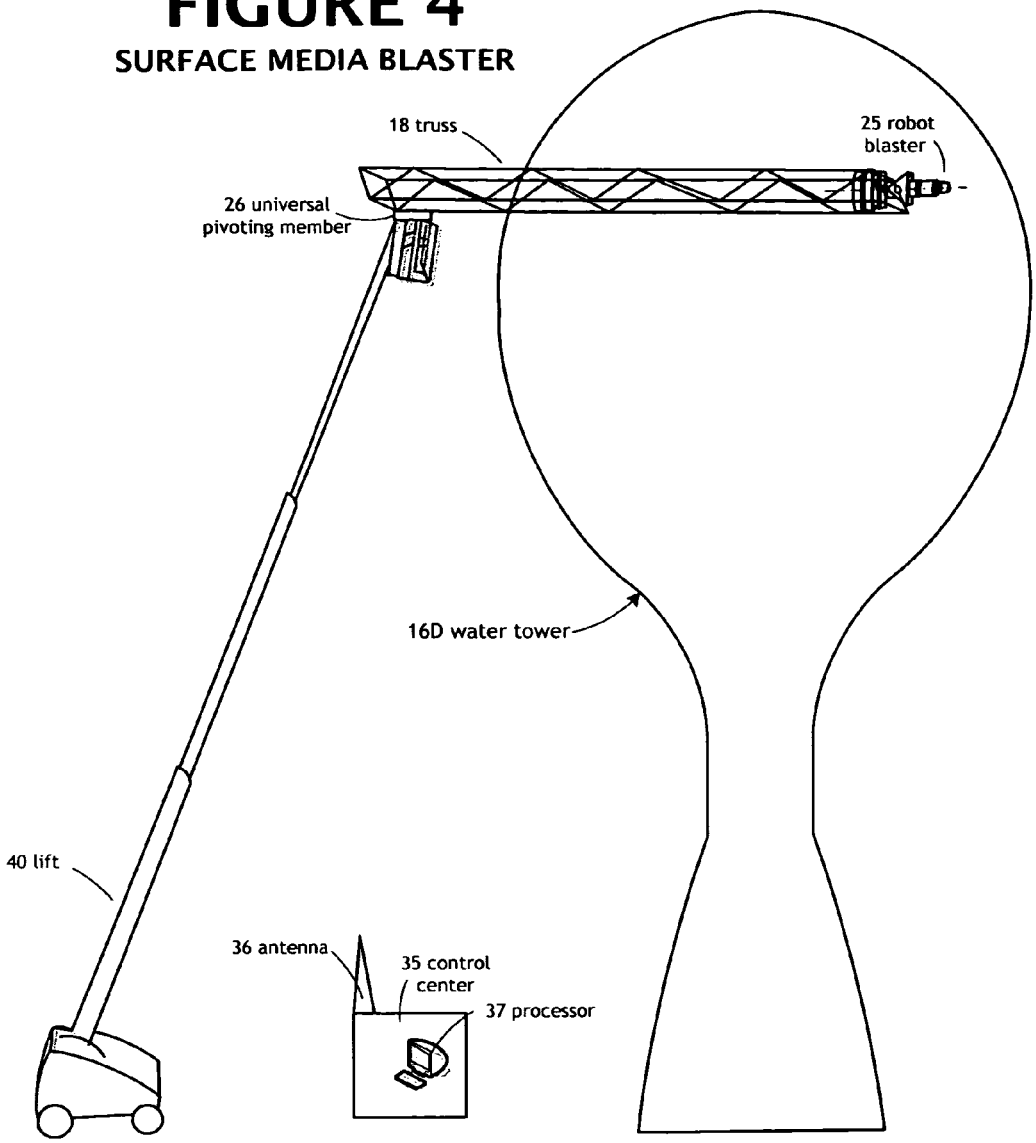
FIG. 4 discloses yet another preferred embodiment of the surface media blaster system of the present invention disposed outside a water tower, the robot blaster being positioned at the end of an extendable arm, the arm being mounted on a frame that pivots relative to a lift positioned adjacent to a water tower.

FIG. 4 discloses yet another preferred embodiment of the surface media blaster system of the present invention disposed outside a water tower, for media blasting the exterior surface of the water tower. A main truss [18] is disposed upon a lift vehicle [40] with an elongated extension, a universal pivoting member [26] resting upon the extension, and an extendable truss arm being securely positioned upon the universal pivoting member [26]. The blasting is performed by a robot blaster [25] disposed at the end of an extendable arm [18]. A universal pivoting member [26] attaching the extendable arm [18] to the connecting crossbeam [20] enables a full 360° of rotation of the robot blaster [25] relative to the interior surface of the water tower [16D]. A control center [35] is situated near the water tower [16D], and enables the position and orientation of the manual operator to be programmed and controlled remotely.

The blasting system is installed into the water tower [16A] in sections with the outer support cables [14, 24] being installed first, with the connecting crossbeam [20] being installed and then the universal pivoting member [26] and finally the Truss [18] with the chosen end effector being installed last. Then the operator proceeds to check the system to insure that all aspects of the system are working correctly and then proceeds to begin the blasting process. Once the blasting is completed, the end effector can be changed to a paint nozzle and the painting may then begin. For the exterior of the tank, or surface, the Truss [18] is installed onto a lift [38] which is then extended to the necessary height and the blasting/painting process may begin as well. Depending on the application, a protective curtain may be used, as is the most common practice, or a blasting media recycling system may be used, thus eliminating the need for a protective cover.

The present invention is a remotely controlled media blasting and subsequent finishing (e.g. painting) tool which will enable a user to clean and paint the inside of municipal water towers without having to be inside of said water towers, as is currently in practice, for extended periods of time. Currently, the only way to perform maintenance of the interior of a water tower, is for an operator to climb into the tower and, using a harness with ladders and platforms and a media blasting gun or paint gun, clean off all of the residue which collects on the inside of water towers and to remove the paint in preparation for a new coat. This is likewise the same for the exterior of the water tower with the difference being the operator stands on a scaffold or at the end of a crane. With this new tool, a series of holes are drilled into the top of the water tower and a series of "D" rings welded to the inside at the base of the bulb of the water tower with steel cables being run through the holes at the top connecting to the "D" rings below. On said cables, the arm of the remotely controlled blasting/painting machine operate is attached. Electro magnets may be substituted to secure the assembly instead of having to use the D-ring method.

The arm of the machine is assembled in sections, which allow for ease of transport and assembly/disassembly. Sections of the arm can added or subtracted depending on the length needed for a given water tower diameter. The arm will have the ability to expand outward and inward six feet depending on needed length and will have a quick detach mechanism on the end to allow different end effectors to be attached. The base of the arm will be secured via pin to the section attached to the cables and will have a gear drive, or high torque servo motor which will allow the operator to move the arm. For safety, there will be "C" channel steel mounted to this base in case of pin failure, preventing the arm from collapsing and falling into the water tower and causing damage and injuring the operator or whomever happens to be in the vicinity.

The base mounted to the cables will be mounted via grade 8 hardware to insure safety and prevent any chance of failure while all other connections will be via hardened steel pin for ease of assembly and disassembly.

The end effectors which can be attached comprise: various media blasting heads, paint guns, a seat for inspecting work done during/after blasting/painting and a robotic arm. Also, if there are any spots that require touch up, or which cannot be reached by the arm remotely by the operator, then the operator can sit in the seat, and controlling the arm thusly, be able to perform any necessary touch up work.

Control of the arm will be via a remote control located in a climate controlled trailer, which further adds to operator comfort because, in the normal method, the operator is suspended via harness inside the water tower which is very hot and humid, increasing operator fatigue and probability of injury while lowering quality of work and the amount of work able to be performed. In order for the operator to see work being performed, up to five (5) cameras will be mounted on the said end.

For the cameras to see what is in the tower, high intensity lights, or infrared illuminators will be utilized as water towers do not have internal lighting systems.

The remote control will have two joysticks which control all of the functions of the arm, the up, down, and side to side movement and up and down the cables mentioned previously; the end effecter being used; be it the media blaster; or the paint gun; or robotic arm; extend and retract the arm as needed. The control box will connected to the arm via a hard wire link which will go run from the control trailer to the arm itself or via wireless link, which will increase functionality and allow the user to take the control box out of the trailer and control the arm anywhere within range of the wireless signal, for example, if the operator needed to be inside the tower on the chair, seat, or basket attached to the arm, the arm could thusly be controlled.

An end effector is the device at the end of a robotic arm, designed to interact with the environment. The exact nature of this device depends on the application of the robot.

In the strict definition, which originates from serial robotic manipulators, the end effector means the last link (or end) of the robot. At this endpoint the tools are attached. In a wider sense, an end effector can be seen as the part of a robot that interacts with the work environment. This does not refer to the wheels of a mobile robot or the feet of a humanoid robot which are also not end effectors—they are part of the robot's mobility.

End effectors may consist of a gripper or a tool. The gripper can be of two fingers, three fingers or even five fingers.

The end effectors that can be used as tools serve various purposes. Such as, Spot welding in an assembly, spray painting where uniformity of painting is necessary and for other purposes where the working conditions are dangerous for human beings.

The end effector of an assembly line robot would typically be a welding head, or a paint spray gun. A surgical robot's end effector could be a scalpel or others tools used in surgery. Other possible end effectors are machine tools, like a drill or milling cutters. The end effector on the space shuttle's robotic arm uses a pattern of wires which close like the aperture of a camera around a handle or other grasping point.

When referring to robotic prehension there are four general categories of robot grippers:

1. Impactive—jaws or claws which physically grasp by direct impact upon the object.
2. Ingressive—pins, needles or hackles which physically penetrate the surface of the object (used in textile, carbon and glass fiber handling).
3. Astrictive—suction forces applied to the objects surface (whether by vacuum, magneto- or electro-adhesion).
4. Contigutive—requiring direct contact for adhesion to take place (such as glue, surface tension or freezing).

Throughout this application, various Patents/Applications are referenced by number and inventor. The disclosures of these documents in their entireties are hereby incorporated by reference into this specification in order to more fully describe the state of the art to which this invention pertains.

It is evident that many alternatives, modifications, and variations of the interior/exterior surface media blaster of the present invention will be apparent to those skilled in the art in light of the disclosure herein. For example, the system can be used for cleaning all kinds of chemical storage tanks, petroleum tanks, ship hulls, and large piping systems. It is intended that the metes and bounds of the present invention be determined by the appended claims rather than by the language of the above specification, and that all such alternatives, modifications, and variations which form a conjointly cooperative equivalent are intended to be included within the spirit and scope of these claims.

PARTS LIST

10. chair
12. slider
14. cable
15. winch
16A. water tower—$1^{st}$ embodiment
16B. water tower—$2^{nd}$ embodiment
16C. water tower—$3^{rd}$ embodiment
16D. water tower—$4^{th}$ embodiment
18. truss
20. connecting crossbeam
22. cable
24. slider
25. robot blaster
26. universal pivoting member
28. stem
30. support truss
32. truss support carriage
33. stabilizer cable
35. control center
36. antenna
37. processor
40. lift

The invention claimed is:

1. A system for delivering media blasting material to a surface, said system comprising:

a substantially upright support structure secured to the surface to be blasted;

a frame extending across said upright support structure;

an arm projecting from said frame, said arm being extendable, said arm being attached to said frame by a section, said section being pivotable relative to said frame, said arm traveling back and forth along said frame between said substantially upright support structure;

a robot blast tool disposed at or near the end of the extendable arm with a media blasting device attached to said robot blast tool enabling said retractable arm to deliver blasting media to said surface to be blasted;

a work station to control operation of said robot blast tool, said work station being remote from said robot blast tool; and whereby, said blasting apparatus is controlled via said remote work station, allowing said media blasting delivery system to blast said surface to be blasted.

2. The system of claim 1, whereby a robotic arm is attached via, quick disconnects to the end of the extendable arm with abrasive delivery nozzles attached to said robot blast tool.

3. The system of claim 1, whereby a series of cameras are attached to the end of said extendable arm, allowing remote operation of said arm.

4. The system of claim 3, whereby said cameras provide night vision capability, lighting and sight distance meters.

5. The system of claim 1, whereby said section is rotatable allowing 360 degree rotation of said extendable arm relative to said frame via a chain drive.

6. A method for delivering media blasting material to a surface, said method comprising:

securing a substantially upright support structure to the surface to be blasted;

positioning an extendable arm relative to a frame, said frame extending across said upright support structure;

positioning a robot tool relative to said surface to be blasted, said robot tool being disposed on said extendable arm, said extendable arm extending from said frame, said extendable arm being attached to said frame by a section, said section being pivotable relative to said frame, said extendable arm traveling back and forth along said frame between said upright support structure; and controlling said robot tool from a control center, said control center being remote from said surface to be blasted.

7. The method of claim 6, further comprising painting or finishing said blasted surface once said blast blasting is completed.

8. The method of claim 6, whereby said indirect controls involve controlling said robot tool from a control center, said control center being remote from said surface to be blasted.

9. A system for delivering media blasting material to a surface, said system comprising:

a substantially upright support structure secured to the surface to be blasted;

a frame extending across said upright support structure;

an arm projecting from said frame, said arm being extendable, said arm being attached to said frame by a section, said section being pivotable relative to said frame, said arm traveling back and forth along said frame between said substantially upright support structure;

a robot blast tool disposed at or near the end of the extendable arm with a media blasting device attached to said robot blast tool enabling said retractable arm to deliver blasting media to said surface to be blasted;

a work station to control operation of said robot blast tool, said work station being remote from said robot blast tool; and whereby, said blasting apparatus is controlled via wireless connectivity, allowing said media blasting delivery system to blast said surface to be blasted.

10. The system of claim 9, whereby a series of cameras are attached to the end of said extendable arm, allowing remote operation of said arm.

11. The system of claim 10, whereby said cameras provide night vision capability, lighting and sight distance meters.

12. The system of claim 9, whereby said section is rotatable allowing 360 degree rotation of said extendable arm relative to said frame via a chain drive.

13. A system for delivering media blasting material to a surface, said system comprising:

a substantially upright support structure secured to the surface to be blasted;

a frame extending across said upright support structure;

an arm projecting from said frame, said arm being extendable, said arm being attached to said frame by a section, said section being pivotable relative to said frame, said arm traveling back and forth along said frame between said substantially upright support structure;

a robot blast tool disposed at or near the end of the extendable arm with a media blasting device attached to said robot blast tool enabling said retractable arm to deliver blasting media to said surface to be blasted;

a work station to control operation of said robot blast tool, said work station being remote from said robot blast tool; and whereby, said blasting apparatus is controlled via a computer control unit, allowing said media blasting delivery system to blast said surface to be blasted.

14. The system of claim 13, whereby a series of cameras are attached to the end of said extendable arm, allowing remote operation of said arm.

15. The system of claim 14, whereby said cameras provide night vision capability, lighting and sight distance meters.

16. The system of claim 13, whereby said section is rotatable allowing 360 degree rotation of said extendable arm relative to said frame via a chain drive.

* * * * *